US011913304B2

(12) United States Patent
Saraya

(10) Patent No.: US 11,913,304 B2
(45) Date of Patent: Feb. 27, 2024

(54) METHODS AND SYSTEMS ASSOCIATED WITH CONVERTING LANDING COLLAR TO HYBRID LANDING COLLAR AND TOE SLEEVE

(71) Applicant: Vertice Oil Tools Inc., Missouri City, TX (US)

(72) Inventor: Mohamed Ibrahim Saraya, Sugar Land, TX (US)

(73) Assignee: Vertice Oil Tools, Inc., Stafford, TX (US)

( * ) Notice: Subject to any disclaimer, the term of this patent is extended or adjusted under 35 U.S.C. 154(b) by 85 days.

(21) Appl. No.: 17/699,620

(22) Filed: Mar. 21, 2022

(65) Prior Publication Data

US 2022/0372842 A1 Nov. 24, 2022

Related U.S. Application Data

(60) Provisional application No. 63/190,268, filed on May 19, 2021.

(51) Int. Cl.

| | |
|---|---|
| ***E21B 43/26*** | (2006.01) |
| ***E21B 33/16*** | (2006.01) |
| ***E21B 34/06*** | (2006.01) |
| ***E21B 34/14*** | (2006.01) |

(52) U.S. Cl.

CPC ..... *E21B 33/165* (2020.05); *E21B 34/063* (2013.01); *E21B 34/14* (2013.01); *E21B 43/261* (2013.01); *E21B 2200/06* (2020.05)

(58) Field of Classification Search

CPC ..... E21B 33/165; E21B 34/063; E21B 34/14; E21B 43/261; E21B 2200/06; E21B 33/16; E21B 34/142

See application file for complete search history.

(56) References Cited

U.S. PATENT DOCUMENTS

| | | | | | |
|---|---|---|---|---|---|
| 3,768,556 | A * | 10/1973 | Baker | E21B 33/146 | 166/318 |
| 4,674,569 | A * | 6/1987 | Revils | E21B 34/14 | 166/318 |
| 4,842,062 | A * | 6/1989 | Schneider | E21B 34/14 | 166/317 |
| 4,880,058 | A * | 11/1989 | Lindsey | E21B 33/146 | 166/291 |
| 4,941,535 | A * | 7/1990 | Porter | E21B 29/00 | 166/373 |
| 5,024,273 | A * | 6/1991 | Coone | E21B 34/142 | 166/383 |
| 5,038,862 | A * | 8/1991 | Giroux | E21B 33/16 | 166/318 |
| 10,260,306 | B1 * | 4/2019 | Beckett | E21B 33/124 | |
| 11,306,562 | B1 * | 4/2022 | Giroux | E21B 34/142 | |
| 2011/0036592 | A1 * | 2/2011 | Fay | E21B 34/063 | 166/374 |
| 2014/0034310 | A1 * | 2/2014 | Andersen | E21B 23/08 | 166/281 |
| 2014/0102703 | A1 * | 4/2014 | Mailand | E21B 34/10 | 166/279 |
| 2014/0338925 | A1 * | 11/2014 | Warlick | E21B 33/13 | 166/387 |

(Continued)

*Primary Examiner* — Steven A MacDonald

(74) *Attorney, Agent, or Firm* — Pierson IP, PLLC

(57) ABSTRACT

A wiper plug to activate an internal sleeve positioned within a landing collar, wherein the landing collar and the internal sleeve are integral components.

20 Claims, 13 Drawing Sheets

(56) References Cited

U.S. PATENT DOCUMENTS

| | | | | |
|---|---|---|---|---|
| 2015/0021021 | A1* | 1/2015 | Merron | E21B 43/14 166/66 |
| 2015/0021026 | A1* | 1/2015 | Giroux | E21B 34/063 166/177.4 |
| 2015/0184489 | A1* | 7/2015 | Resweber | E21B 34/14 166/183 |
| 2015/0308228 | A1* | 10/2015 | Vick, Jr. | E21B 34/12 166/334.1 |
| 2015/0330181 | A1* | 11/2015 | Budde | E21B 34/142 166/185 |
| 2016/0265302 | A1* | 9/2016 | Acosta | E21B 33/12 |
| 2016/0326832 | A1* | 11/2016 | Watson | E21B 34/10 |
| 2017/0370185 | A1* | 12/2017 | Saraya | E21B 43/14 |
| 2018/0334882 | A1* | 11/2018 | Brandsdal | E21B 33/1208 |

* cited by examiner

METHODS AND SYSTEMS ASSOCIATED WITH CONVERTING LANDING COLLAR TO HYBRID LANDING COLLAR AND TOE SLEEVE

BACKGROUND INFORMATION

Field of the Disclosure

Examples of the present disclosure relate to downhole tools utilizing a wiper plug or solid object to create a conduit inside a casing string via activating an internal sleeve positioned within a landing collar, wherein the landing collar and the internal sleeve are integral components. More specifically, embodiments are directed towards aligning first ports associated with the landing collar with second ports associated with the internal sleeve via a wiper plug or solid object.

Background

Hydraulic fracturing is the process of creating cracks or fractures in underground geological formations. After creating the cracks or fractures, a mixture of water, sand, and other chemical additives are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Before the cracks or fractures in the underground formations are created, cement is pumped through casing in order to cement the casing into the wellbore. After cementing, a conduit between the wellbore and the formation must be created/re-opened in order to communication for stimulation and production be achieved and to allow frac plugs, perforating guns and other down hole tools to be pumped downhole.

Conventionally, to cement the wellbore, a wiper plug is run in hole and lands on a landing collar to move the cement out of the casing string. Then, a toe sleeve positioned above the landing collar is activated to create the fractures.

However, this requires strings or casing joints to couple the toe sleeve with the landing collar. Additionally, this creates additional length and costs in the lateral by requiring two separate parts which may also cause restrictions in the wellbore, lack of full utilization of drilled well length, and extra cost associated due to using more than one tool.

Accordingly, needs exist for systems and methods that can do the functionality of landing collar and toe sleeve in one tool, utilizing a wiper plug to align first ports associated with the landing collar housing with second ports associated with an internal sleeve, wherein the wiper plug is configured to move the internal sleeve to align the ports.

SUMMARY

Embodiments disclosed herein describe systems and methods utilizing a landing collar housing with first ports and an internal sleeve with second ports. The first ports and the second ports are configured align based on a wiper plug or solid object landing on the internal sleeve, and the wiper plug moving the internal sleeve to a shoulder within the landing collar. The movement of the internal sleeve may align the first and second ports. In embodiments, the internal sleeve may be positioned within the landing collar to minimize a length of a shoe track. Embodiments may include a landing collar housing called for brevity "landing collar" thereafter, internal sleeve, and a wiper plug.

The landing collar may be positioned on a float shoe, which may be an integral part of the landing collar or it may be equipped with float valves and run above the float shoe. The landing collar may be a component that is installed near a bottom of the casing string and be configured to receive the wiper plug or another solid object during a cementing operation. In embodiments, the landing collar may be a component installed near the bottom of the casing string on which a cement plug lands on during a primary cementing operation. The landing collar may include a shoulder and first ports.

The shoulder may be a projection extending from the inner diameter of the landing collar towards a central axis of the landing collar, which may reduce an inner diameter of the landing collar. The shoulder may be configured to receive a distal end of the internal sleeve and limit the movement of the internal sleeve in a first direction, wherein the first direction may be a downhole direction.

The first ports may be hollow passageways extending from the inner diameter of the landing collar to the outer diameter of the collar. The first ports may be configured to allow communication between areas outside of the landing collar to an area inside of the landing collar.

The internal sleeve may be a sliding sleeve that is positioned within the landing collar. The internal sleeve may be positioned between a proximal end and a distal end of the landing collar, such that the entirety of the internal sleeve may overlap with the landing collar and none of the internal sleeve is exposed outside of the landing collar. An outer diameter of the internal sleeve may initially be coupled to the internal diameter of the landing collar via temporary coupling mechanisms, such as shear pins, shear rings, or any other device that is configured to temporarily secure the internal sleeve in place. The internal sleeve may include second ports, a proximal end, and a distal end.

The second ports may extend from an inner diameter of the internal sleeve to an outer diameter of the internal sleeve to allow communications through the second ports. The second ports may be configured to be selectively misaligned and aligned with the first ports. When run in hole, the second ports may be misaligned with the first ports. Responsive to moving the internal sleeve to land on the shoulder of the landing collar, the first ports and the second ports may be aligned to allow communication through the first ports and the second ports. In embodiments, the first and second ports may be misaligned during the cementing operation while the cement is being pumped downhole, and the first ports and the second ports may be aligned when the cement is being displaced through the float shoe.

The distal end of the internal sleeve may include a first projection that reduces the inner diameter of the internal sleeve. The first projection may be configured to receive a nose of the wiper plug, and receive forces applied by the wiper plug or a solid object to move the internal sleeve to land on the shoulder of the landing collar. The proximal end of the internal sleeve may include a second projection that reduces the inner diameter of the internal sleeve. The second projection is configured to form a seal with a proximal end of the wiper plug or the solid object to limit communication across the wiper plug and the internal sleeve in multiple directions. In embodiments, the inner diameter across the first projection may be smaller than that across the second projection, which may allow fins and the nose of the wiper plug to move into the internal sleeve without moving past the internal sleeve.

The wiper plug may be a cementing plug that is configured to move cement slurry and other fluids through casing. The wiper plug may be configured to be pumped downhole to be positioned on the first projection of the internal sleeve, form a seal across the first projection, and move the internal sleeve in a first direction. In embodiments, the wiper plug may move the internal sleeve based on hydraulic forces being applied to a proximal end of the wiper plug. The wiper plug may move the internal sleeve until the first projection is positioned adjacent to the shoulder of the landing collar to align the first ports and the second ports. Accordingly, the first ports and the second ports may be activated and become aligned based on hydraulic pressures applied to wiper plug to move the internal sleeve within the landing collar. In other words, the landing collar and the internal sleeve may be activated by the wiper plug. The wiper plug may have fins, a front seal, back seal, conduit, a seat for a dissolvable object, windows. In another embodiments, the wiper plug may be a solid object and it can be built entirely from dissolvable material, or it may be a solid object built entirely from dissolvable material and equipped with fins, a front seal, back seal, conduit.

The fins may be rubber projections extending away from an outer diameter of the wiper plug, and be configured to displace cement and cleaning debris from the inner diameter of casing. The fins may be made of dissolvable or non-dissolvable rubber.

The front seal may be positioned on a nose of the wiper plug and be configured to form a seal between the first projection and an outer diameter of the wiper plug. The nose of the wiper plug may be a solid object, and not allow communication into the wiper plug, wherein the nose is configured to land within the first projection. In embodiments, the front seal may be formed of an O-ring, rubber, metal to metal contact, a combination thereof, etc. In other embodiments, the front seal may be placed anywhere on the distal end of the wiper plug including the wiper plug nose The back seal may be positioned on a proximal end of the wiper plug and be configured to form a seal between the second projection and the outer diameter of the wiper plug. In embodiments, the back seal may be formed of an O-ring, rubber, metal to metal contact, a combination thereof, etc.

The conduit may be a passageway with a first opening positioned on the proximal end of the wiper plug, extend towards the object seat, and have a second opening within the windows. The conduit may allow communication from an area associated with the windows of the wiper plug to an area above the wiper plug, wherein the area above the wiper plug may be between the proximal end of the wiper plug and the proximal end of the landing collar. The conduit may be made of dissolvable material or include an object seat, which is configured to receive a dissolvable object, such as a ball, disc, cartridge, or no dissolvable rupture disc etc. In another embodiment, the conduit may entirely constitute the dissolvable object.

The seat for a dissolvable object may be positioned along the conduit, and may be configured to secure a dissolvable object in place. When the dissolvable object is intact, the conduit may be block, and communication may not be able to flow through the conduit. Responsive to the object being removed or decrease in size, the conduit may be exposed and fluid may flow between the windows and an area above the wiper plug through the conduit. In embodiments, the seat may be configured to restrict the movement of the fluid in a first direction and a second direction, or only in a first direction. In other embodiments, the dissolvable object may be replaced with a shearable device that may be removed after reaching a pressure threshold.

The windows may be openings within the sidewalls of the wiper plug, wherein the windows may allow communication between the conduit and an inner diameter of the landing collar, as well as the internal sleeve. In embodiments, fluid flowing through the conduit may subsequently flow out of the windows and through the first ports and the second ports.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
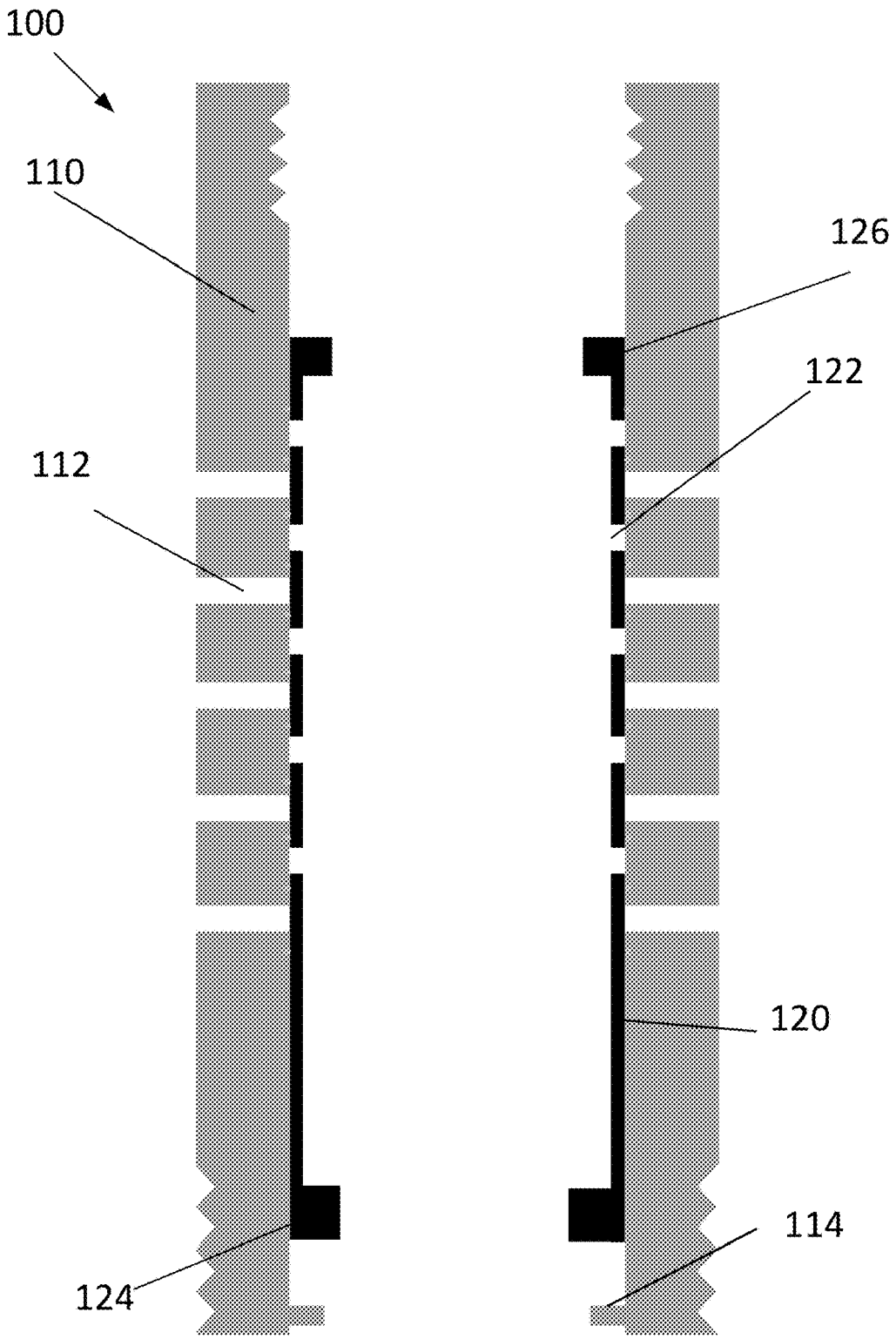
FIG. 1 depicts a landing collar with an internal sleeve, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may include a landing collar 110 with an internal sleeve 120, wherein internal sleeve 120 is positioned on an inner circumference of landing collar 110. In other embodiment, the landing collar may be equipped with float valves below the internal sleeve 120.

Landing collar 110 may be configured to be positioned downhole above a float shoe. In embodiments, the float shoe may be an integral component of landing collar 110 or the landing collar 110 may be equipped with its own float valves and run above the shoe. Landing collar 110 may include first ports 112 and shoulder 114. First ports 112 may be hollow or equipped with rupture disc or dissolvable material that may rupture or dissolve.

First ports 112 may be a series of hollow passageways extending from an inner diameter of landing collar 110 to an outer diameter of landing collar 110. First ports 112 may be configured to selectively allow communication through landing collar 110.

Shoulder 114 may be a projection extending from the inner diameter of landing collar 110 towards a central axis of downhole tool 100. Shoulder 114 may change and decrease an inner profile of landing collar 110 to limit the movement of internal sleeve 120 in a first direction.

Internal sleeve 120 may be a sliding sleeve that is positioned on the inner circumference of landing collar 110. Internal sleeve 120 may be configured to move in a first direction based on a force being applied to internal sleeve 120 in the first direction being greater than a force threshold. In embodiments, internal sleeve 120 may move based on hydraulic forces being applied to a wiper plug. When run in hole, internal sleeve 120 may be in a first position and be coupled to internal landing collar 110 via a temporary coupling mechanism, such as shear screws, pins, etc. Further, internal sleeve 120 may be pressure balanced and may not move due to any pressure being applied to an interior or exterior of internal sleeve 120. However, once the wiper plug or solid object lands on the internal sleeve 120 and a force threshold is reached, the temporary coupling mechanisms may break or move allowing internal sleeve 120 to move in the first direction. After internal sleeve 120 moves in the first direction, internal sleeve 120 may be located at a second position. Internal sleeve 120 may include second ports 122, distal end 124, and proximal end 126.

Second ports 122 may be a series of hollow passageways extending from an inner diameter of internal sleeve 120 to an outer diameter of internal sleeve 120. Second ports 122 may be configured to selectively allow communication through landing collar 110. When run in hole in the first position, second ports 122 may be misaligned with first ports 112. As such, before a cementing operation and while cement is pumped downhole, the misalignment of first ports 112 and second ports 122 may not allow communication between an internal diameter of landing collar 110 and an annulus. In the second position, after the wiper plug is pumped downhole, lands on landing collar 110, and shifts internal sleeve 120, second ports 122 may move to become aligned with first ports 112 to allow communication.

Distal end 124 may include a first projection that reduces the inner diameter of internal sleeve 120. This reduction of diameter may be configured to allow the wiper plug to be seated on the first projection and form a seal. In embodiments, the first projection and the distal end 124 may be offset from shoulder 114 when run in hole in the first position. When internal sleeve 120 is in the second position, distal end 124 and the first projection may be positioned on shoulder 114.

Proximal end 126 of the internal sleeve may include a second projection that reduces the inner diameter of internal sleeve 126. The second projection is configured to form a seal with a proximal end of the wiper plug to limit communication across the wiper plug and internal sleeve 120 in multiple directions. In embodiments, the inner diameter across the first projection may be smaller than that across the second projection, which may allow the fins and nose associated with the wiper plug to move into the internal sleeve 120 without moving the internal sleeve 120 until the nose of wiper plug lands on distal end 124, and proximal end 126 of the wiper plug forms a seal with the proximal end of the wiper plug.

Figure 2:
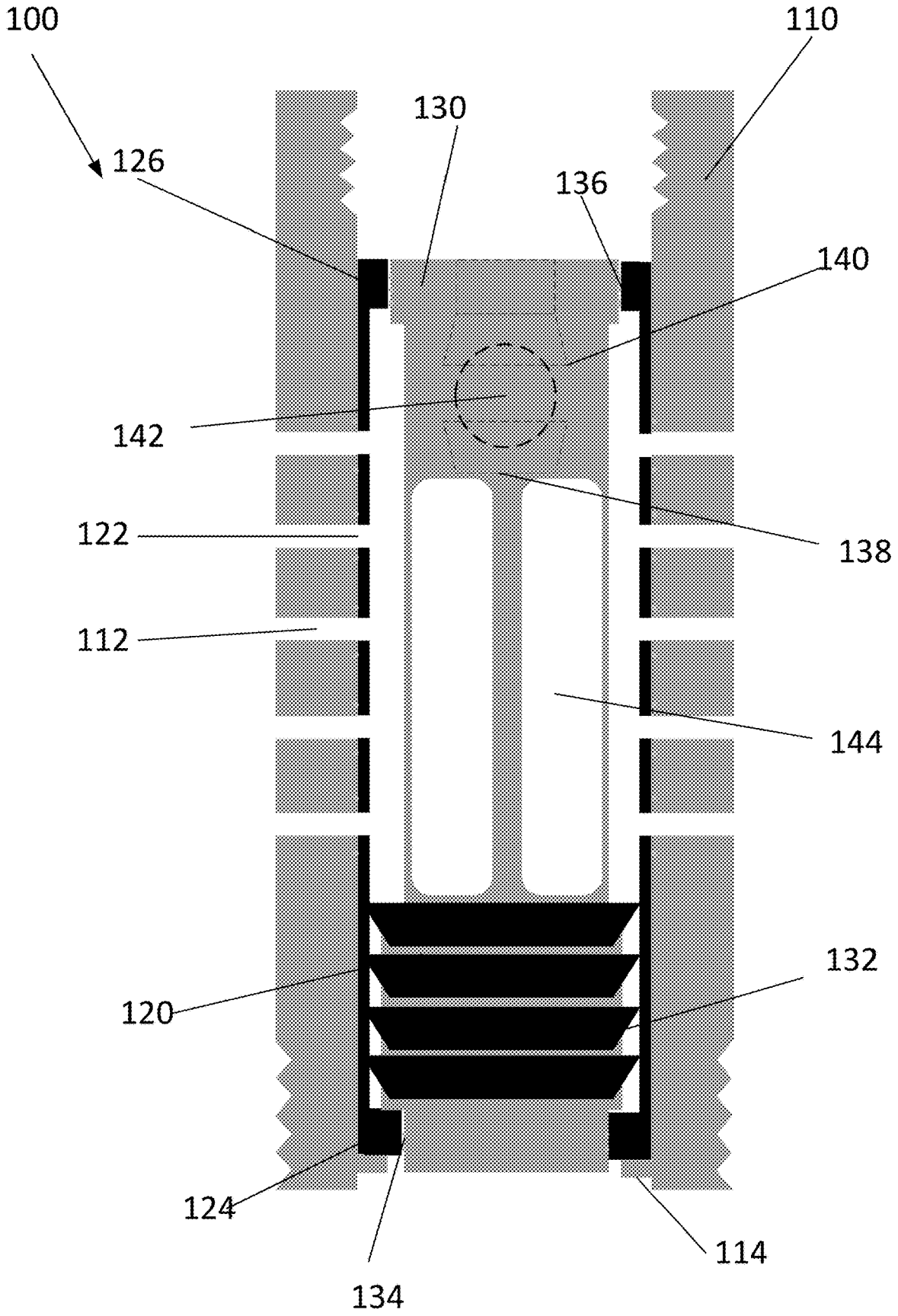
FIG. 2 depicts a landing collar with an internal sleeve that is activated via a wiper plug, according to an embodiment.

FIG. 2 depicts a wiper plug body 130 positioned on internal sleeve 120 after activation, according to an embodiment. Elements depicted in FIG. 2 may be described above, and for the sake of brevity a further description of these elements is omitted.

Wiper plug body 130 may be a cementing plug that is configured to move cement slurry and other fluids through casing when being pumped downhole. Wiper plug body 130 may be configured to move within internal sleeve 120 in a downhole direction, land on the first projection at the distal end 124 of internal sleeve 120, apply forces to internal sleeve 120, and move the internal sleeve 120 from the first position to the second position. Wiper plug body 130 may include fins 132, front seal 134. In other embodiments, the wiper plug may include back seal 136, conduit 138, seat 140, dissolvable object 142, and windows 144.

Fins 132 may be rubber projections extending away from an outer diameter of wiper plug body 130. Fins 132 may be configured to displace cement and cleaning debris from an inner diameter of casing. In embodiments, fins 132 may have a larger diameter than that of front seal 134.

Front seal 134 may be positioned on a nose of wiper plug body 130, and be configured to form a seal between the nose of wiper plug body 130 and distal end 124 of internal sleeve 120. Front seal 134 may not allow fluid to flow between an area below wiper plug body 130 into an area within internal sleeve 120. In embodiments, front seal 134 may be formed of an O-ring, rubber, metal to metal contact, etc. In other embodiment front seal may be positioned on other parts of the wiper plug distal end.

Back seal 136 may be positioned on a proximal end of wiper plug body 130, and be configured to form a seal between the second projection and the outer diameter of wiper plug body 130. In embodiments, the back seal may be formed of an O-ring, rubber, metal to metal contact, etc. Back seal 136 may not allow fluid to flow from an area above wiper plug body 130 into an area within internal sleeve 120.

Conduit 138 may be a passageway positioned on the proximal end of wiper plug 138. Conduit 138 may have a first opening that is positioned on the proximal end of wiper plug body 130, extend through seat 140, and have a second opening positioned within windows 144. When conduit 138 is not obstructed by an object 142, conduit 138 may allow communication between an area associated with the windows 144 and an area above wiper plug 138. However, when conduit 138 is blocked by object 142, communication through conduit 138 may be restricted.

Object seat 140 may be positioned between the first end and second end of conduit 140, and may configured to receive object 142, such as a dissolvable ball, disc, cartridge, etc. Object seat 140 may include a lower portion and/or an upper portion, which may restrict the movement of object 142 in a first direction and/or a second direction. Responsive to object 142 being removed, fluid may flow between the first end and second end of conduit 138. In another embodiment object 142 may be seated on the proximal end of the wiper plug Windows 144 may be openings within the sidewalls of the wiper plug body 130. A second end of conduit 138 may flow into windows 144, wherein windows 144 allow communication between conduit 138 and an inner diameter of landing collar 110 and/or internal sleeve 120. In embodiments, fluid flowing through the conduit 142 may subsequently flow out of windows 144, and through the first ports 112 and second ports 122.

Figure 3:
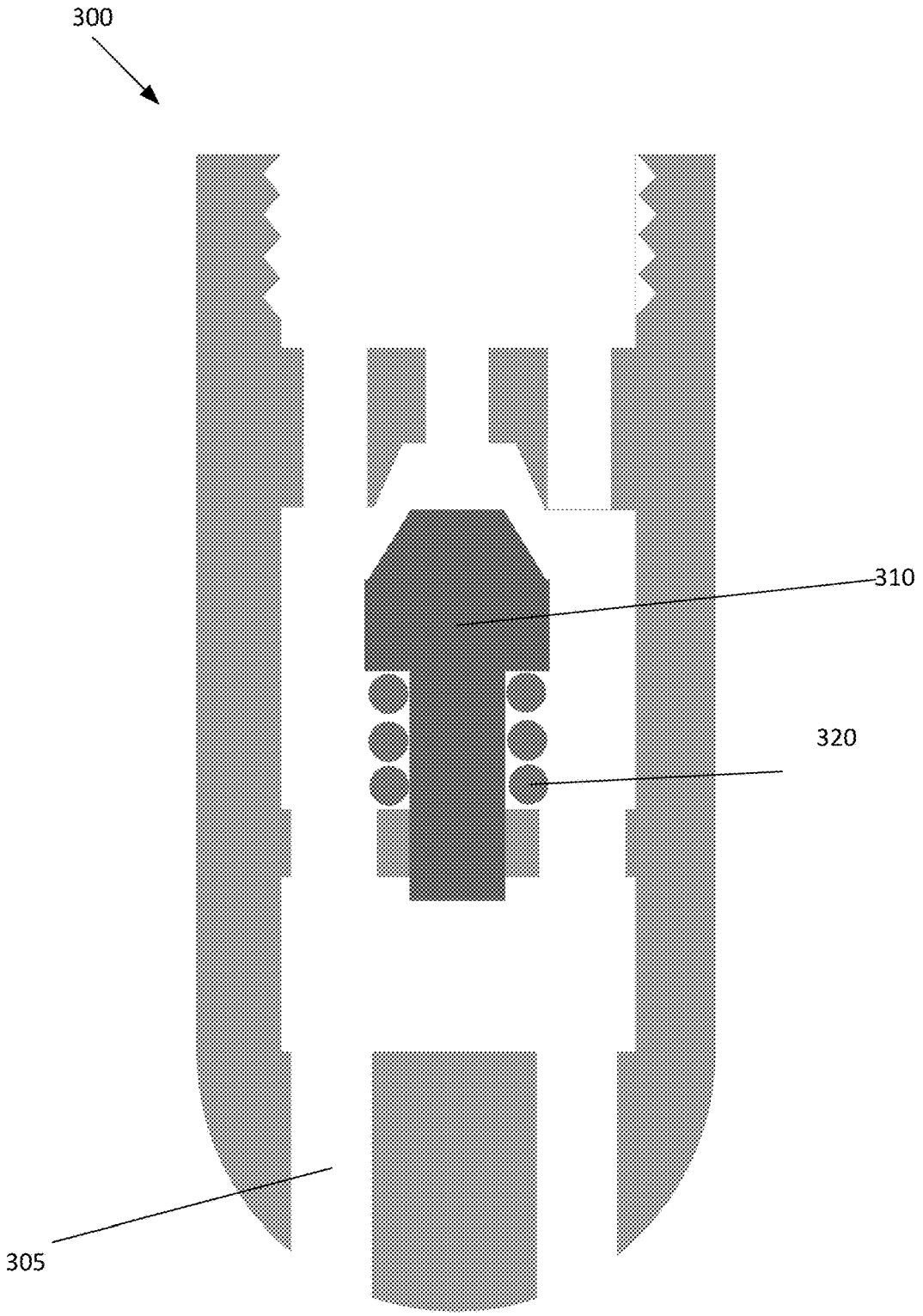
FIG. 3 depicts a float shoe, according to an embodiment.
Figure 4:
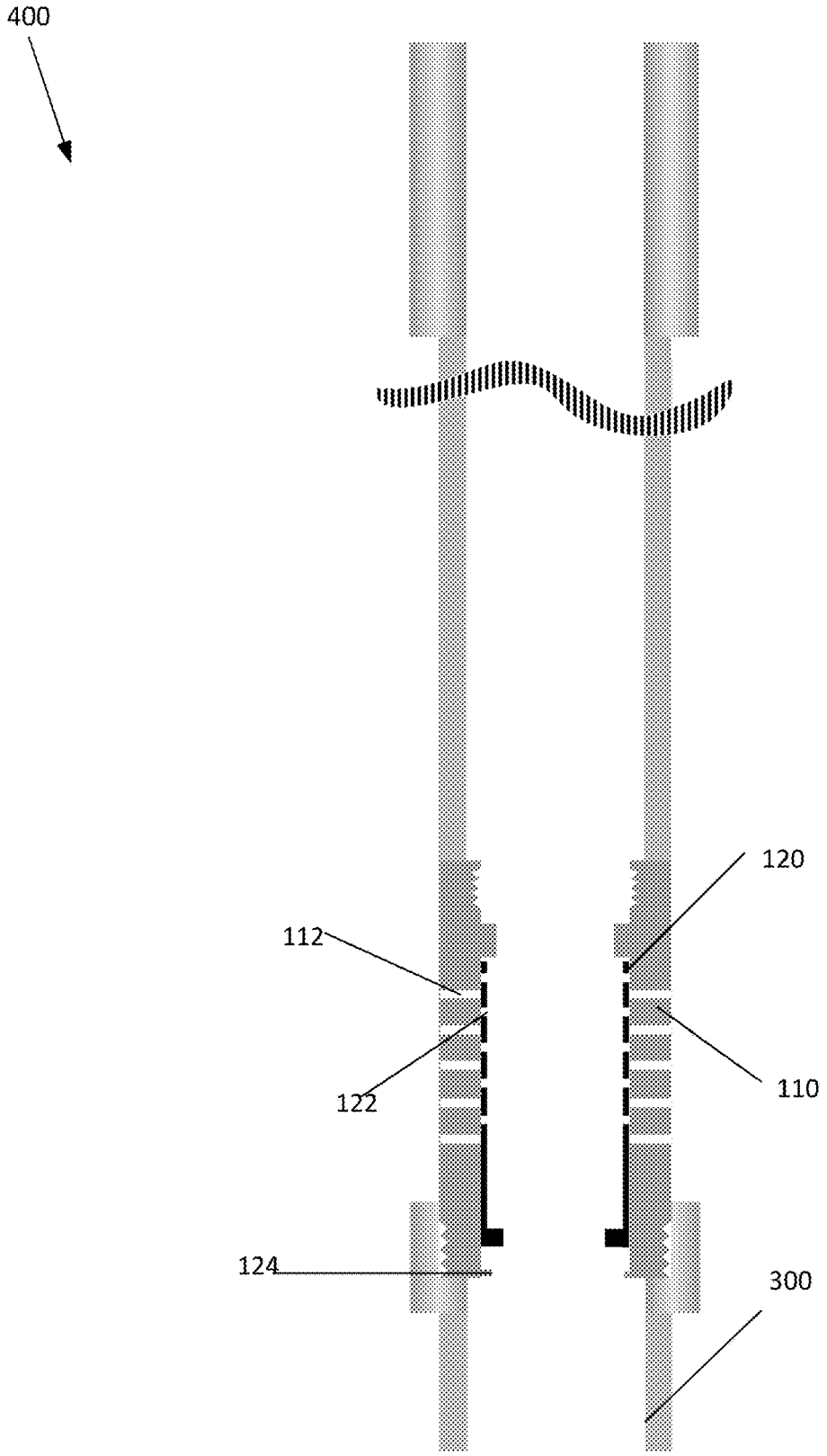
FIG. 4-7 depict an operational sequence of activating a landing collar with an internal sleeve via a wiper plug, according to an embodiment.
Figure 5:
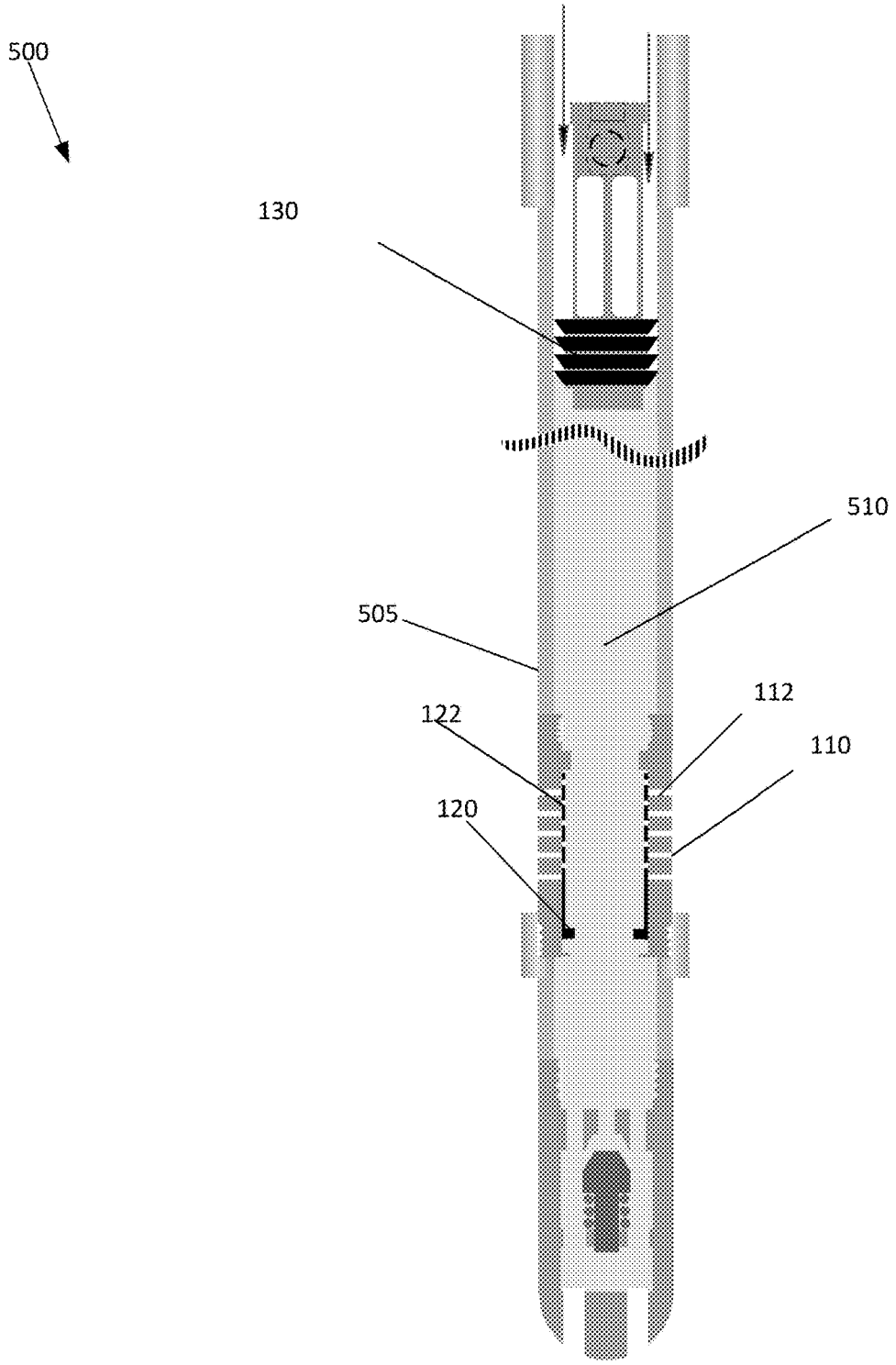
Figure 6:
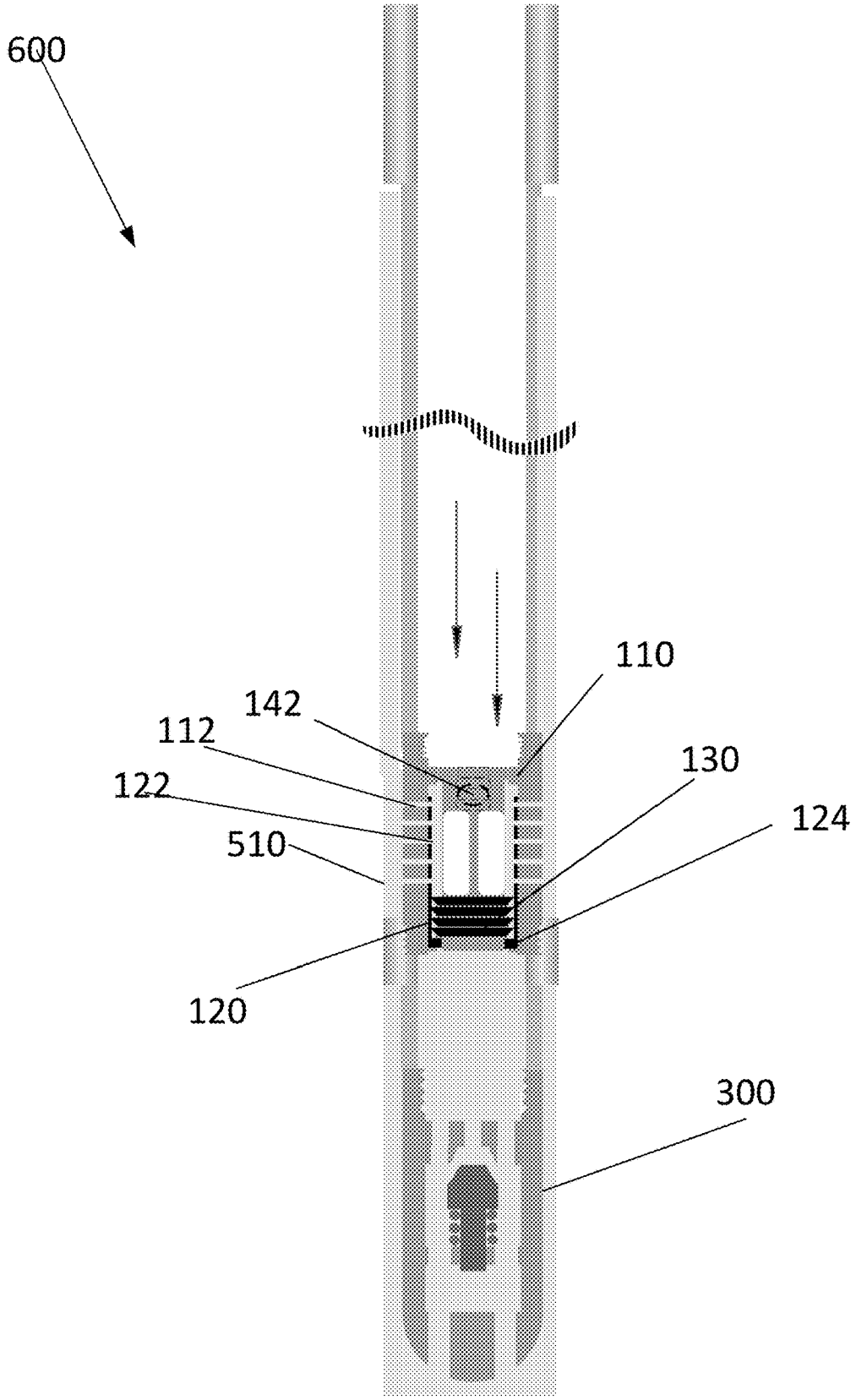
Figure 7:
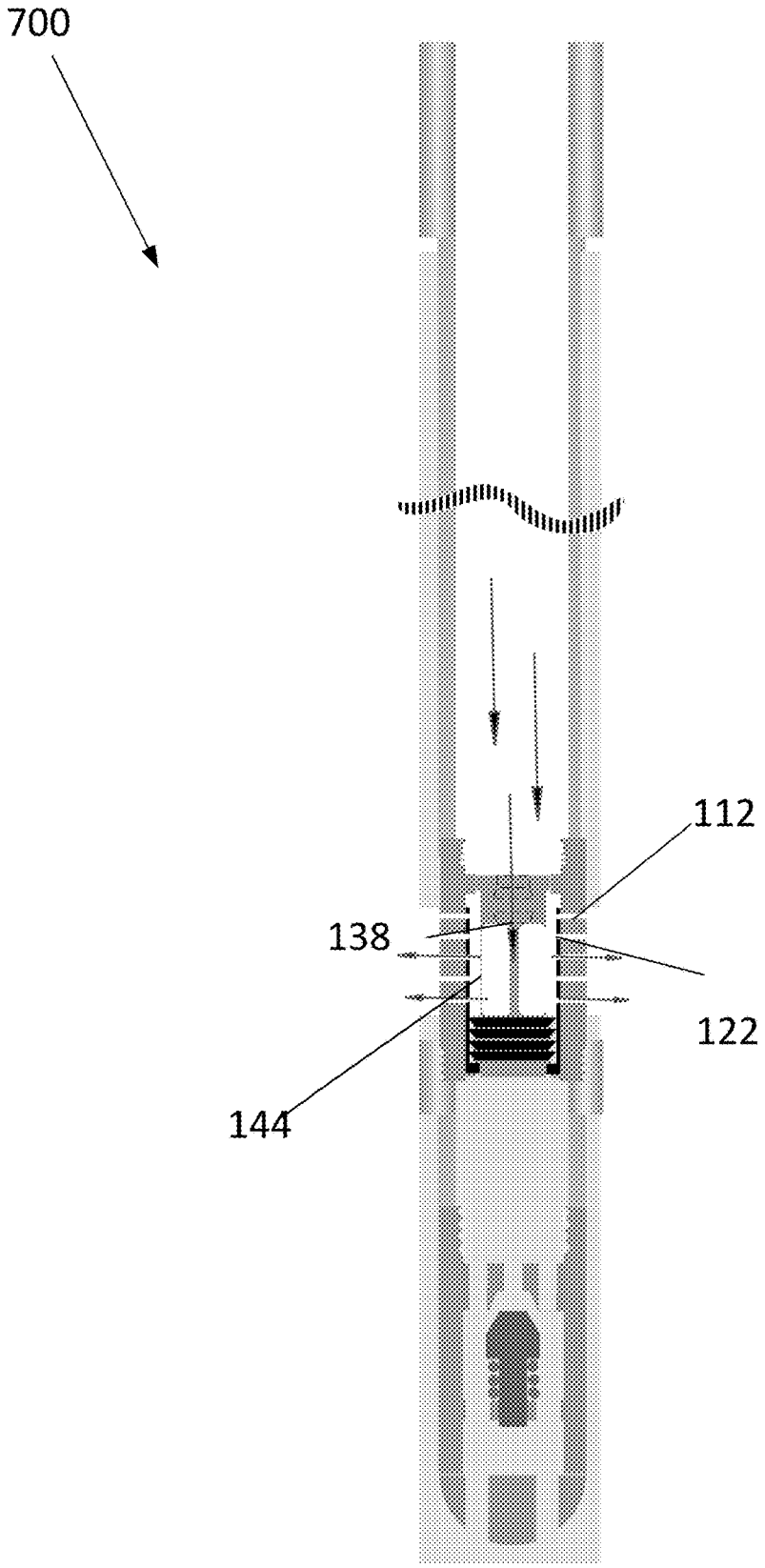

FIG. 3 depicts a float shoe 300, according to an embodiment. Float shoe 300 may be an integral component with landing collar 110, and may be run in hole together as one tool.

Float shoe 300 may be coupled to the end of casing string. Float shoe 300 may have a spring loaded 320 one way valve 310. The one way valve 310 may prevent reverse flow of cement slurry from an annulus into the casing. One way valve 310 may allow circulation through bottom ports 305 during cementing operations. One skilled in the art may appreciate that float shoe 300 may be any type of float shoe. In other embodiments, the landing collar 110 and internal sleeve 120 maybe coupled directly to the top of the shoe or be an integral part of the shoe FIGS. 4-7 depict operation sequences for a landing collar 110 with an internal sleeve 120 that is activated by a wiper plug body 130, according to an embodiment. The operations of operational sequence presented below are intended to be illustrative. In some embodiments, operational sequence may be accomplished with one or more additional operations not described, and/or without one or more of the operations discussed. Additionally, the order in which the operations of operational sequence are illustrated in FIGS. 4-7 and described below is not intended to be limiting.

At operation 400, a landing collar 110 with an internal sleeve 120 may be run in hole as integral part of the casing before a cementing operation. In other embodiments, the cementing operation may be omitted. When landing collar 110 and internal sleeve 120 are run in hole, first ports 112 may be misaligned with second ports 122, and first ports 112 may be blocked by sidewalls of internal sleeve 120. This may limit communication from inside landing collar 110 to outside landing collar 110 through ports 112, 122. In other embodiments, ports 112 may be equipped/filled with dissolvable material or rupture discs which may limit the communication between inside landing collar 110 and outside landing collar 110.

At operation 500, cement 510 may be pumped within casing 505 ahead of wiper plug body 130. When cement 510 is being pumped downhole, first ports 112 and second ports 122 may be misaligned.

At operation 600, wiper plug body 130 may be pumped downhole and land on internal sleeve 120, while internal sleeve 120 is in the first position. While wiper plug body 130 is being pumped downhole, internal sleeve 120 may be maintained in the first position and the wiper plug may move cement and other fluids through the float shoe 300 to be displaced into an annulus, wherein the float shoe 330 is positioned below a distal end of the landing collar 110. Further, float shoe 330 may have ports that allow for reverse circulation of the cement out of the distal end of float shoe 330.

When wiper plug body 130 has landed on internal sleeve 120, a front seal and a back seal may be formed between wiper plug body 130 and internal sleeve 120, and a pressure above wiper plug body 130 may increase past a pressure threshold by hydraulic forces being applied against wiper plug 130. This increase in pressure may cause temporarily coupling mechanisms to break or move, and internal sleeve 120 to move downhole to be in the second position. When internal sleeve 120 moves to the second position, first ports 112 and second ports 122 may be aligned. However, fluid may not flow through the conduit within wiper plug body 130 because object 142 may remain intact. Accordingly, even if first ports 112 and second ports 112 are aligned, communication into an annulus may be limited or restricted based on object 142 block the conduit.

In other embodiments, object 142 may not exist and the wiper plug body 130 may be a dissolvable or disappearing element. Further, in other embodiment the wiper plug 130 may not have the proximal end sealing or conduit and ports 112 may just prevent fluid from flow to the internal of the landing collar 110 due to existence of dissolvable material or rupture disc being equipped inside the landing collar ports 112, in such embodiment projection 126 may not be required.

At operation 700, object 142 may be removed, dissolved, etc. In embodiments, object 142 may be removed after a predetermined amount of time, a pressure applied to object 142 being above a threshold, chemicals interacting with object 142, heat coupled with time, or any other known mechanism to remove object 142 without running additional tools downhole. This may expose conduit 138 without positioning any further tools downhole.

When object 142 is removed from wiper plug body 130, conduit 138 may allow fluid to flow between an area above wiper plug body 130 and windows 144. As such, fluid may be pumped into windows 144 through conduit 138, and then through aligned first ports 122 and second ports 122 to perform fracturing operations, such as perforating the cemented well. Object 142 may be mounted inside or above the wiper plug, i.e.: it can be a ball set over a ball seat over wiper plug body 138. In other embodiments, object 142 may not exist and the wiper plug body 130 may be the part that dissolves or disappear or it can be short enough to seat below the most distal landing collar ports 112. When wiper plug body 130 is dissolving, disappearing, more of windows 144 may increase in size exposing more surface area of the wiper plug body 130 to allow quicker dissolution. For embodiment where wiper plug body 130 is short, object 142 and windows 144 may not be needed while landing collar ports 112 will be equipped/filled with dissolvable material or rupture disc.

Figure 8:
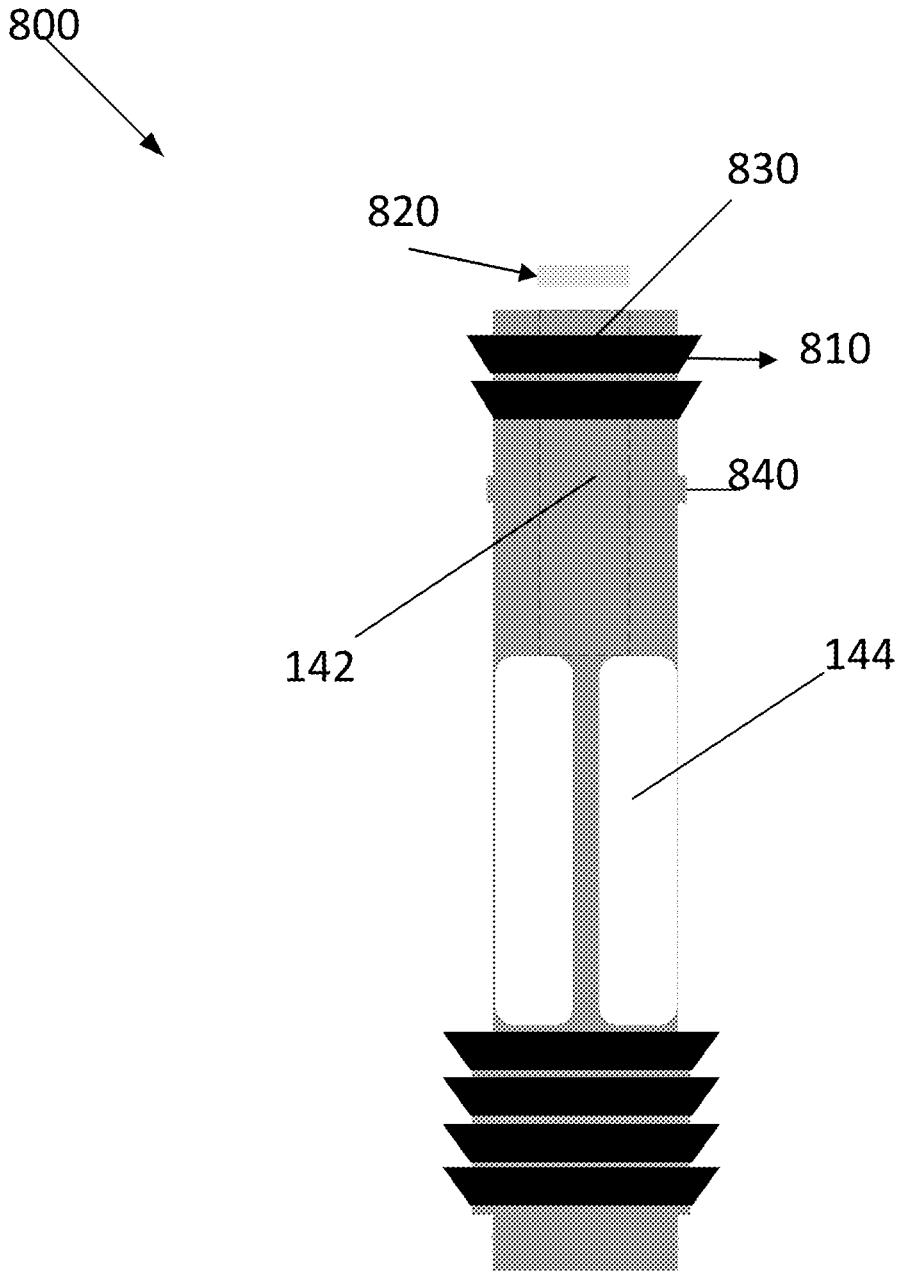
FIG. 8 depicts a wiper plug utilized to activate an internal sleeve within a landing collar, according to an embodiment.
Figure 9:
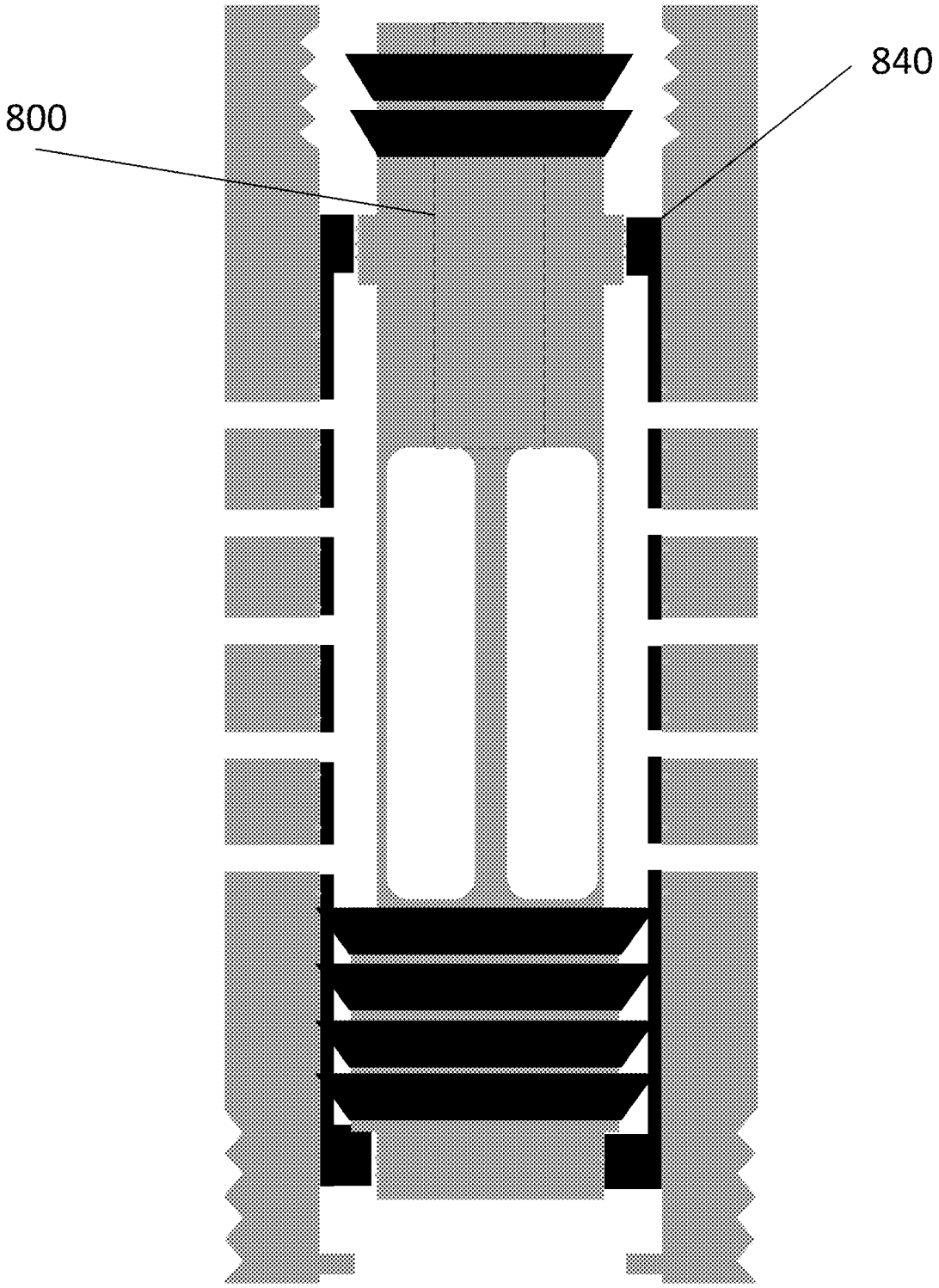
FIG. 9 depicts a landing collar with an internal sleeve that is activated via a wiper plug, according to an embodiment.

FIGS. 8 and 9 depict a wiper plug system 800, according to an embodiment. Elements described in FIG. 8 may be described above, and for the sake of brevity a further description of these elements may be omitted.

As depicted in FIG. 8, wiper plug 800 may include a dissolvable cartridge 820 that is configured to be positioned within a cartridge seat 830 on a proximal most end of wiper plug 800. Wiper plug 800 may also include stabilizing fins 810 positioned between windows 144 and the cartridge seat 830, wherein conduit 142 may extend past the stabilizing fins 810. In other embodiments, the cartridge may be replaced with a ball that seats inside or above the proximal end of the wiper plug body 138. The ball may be made of dissolvable material, composite, aluminum or any other mechanically acceptable material.

Furthermore, wiper plug 800 may include a back seal 840 that is positioned on an outer diameter of wiper plug 800 between windows 144 and stabilizing fins 810. As depicted in FIG. 9, back seal 840 may be configured to form a seal between an internal sleeve 120 and the outer diameter of wiper plug 800 to limit communications between the internal sleeve and an area above wiper plug 800. This may allow portions of wiper plug 800 to protrude away from the rear of internal sleeve 120. In other embodiments, the seal can be established using the wiper plug fins which are used to wipe casing internal diameter after pumping cement.

Figure 10:
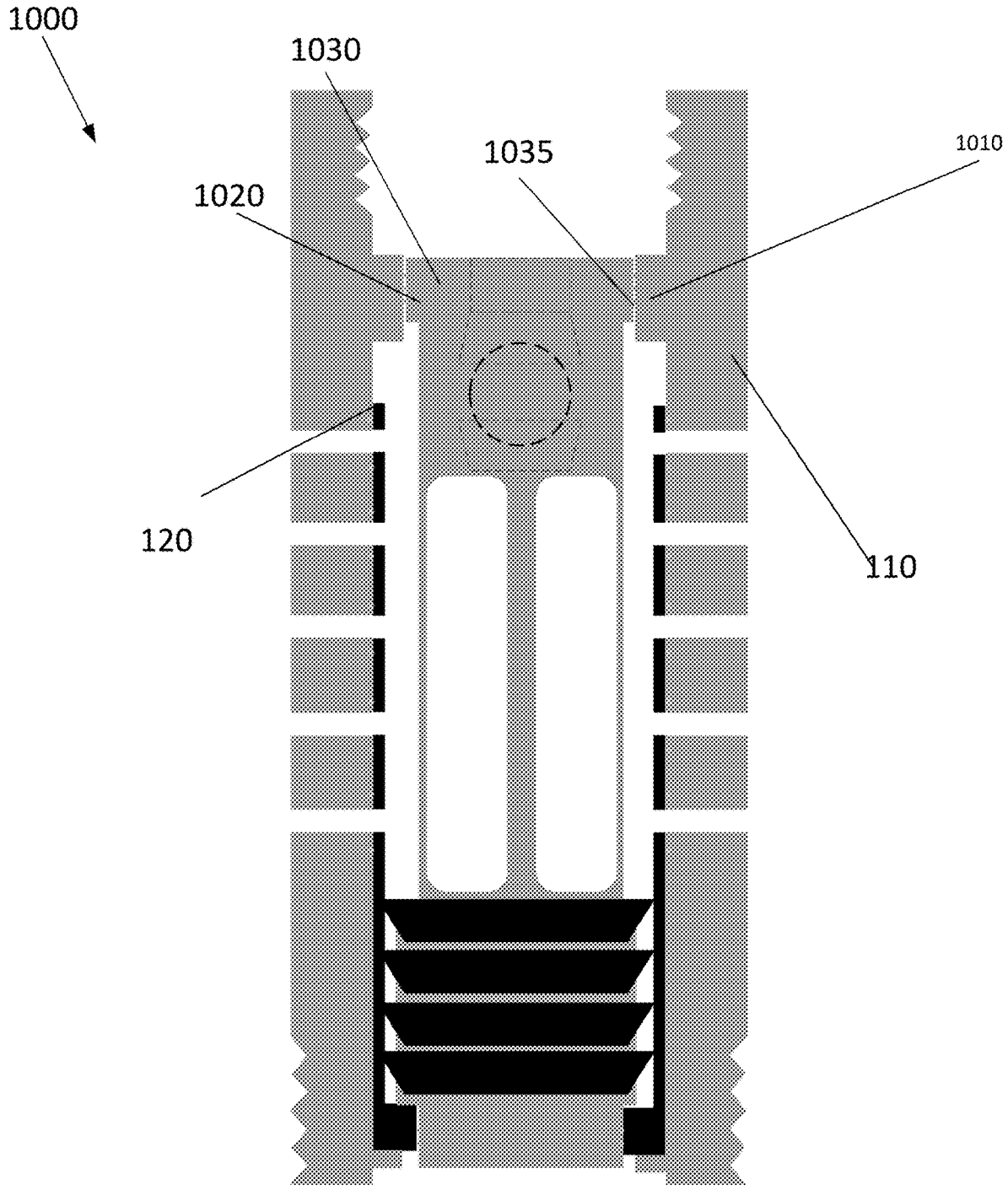
FIG. 10 depicts a landing collar with an internal sleeve before it is activated via a wiper plug, according to an embodiment.

FIG. 10 depicts a wiper plug system 1000, according to an embodiment. Elements described in FIG. 10 may be described above, and for the sake of brevity a further description of these elements may be omitted.

As depicted in FIG. 10, a back seal 1035 may be formed between a projection 1010 on landing collar 110 and a projection 1020 on wiper plug 1030. This may enable a back seal 1035 to be formed between landing collar 110 and wiper plug 1030, and be independent from internal sleeve 120.

Figure 11:
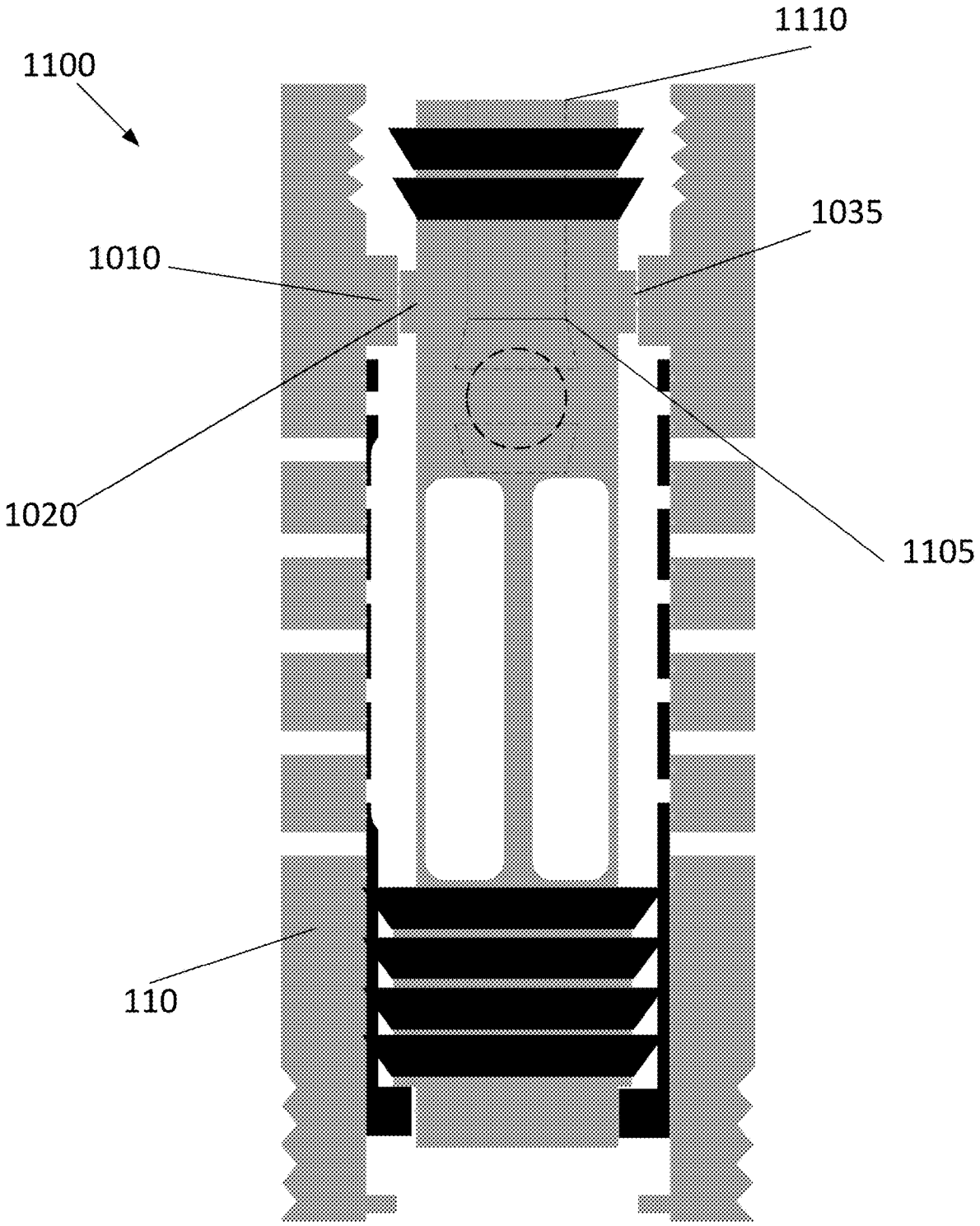
FIG. 11 depicts a landing collar with an internal sleeve before it is activated via a wiper plug, according to an embodiment.

FIG. 11 depicts a wiper plug system 1100, according to an embodiment. Elements described in FIG. 11 may be described above, and for the sake of brevity a further description of these elements may be omitted.

As depicted in FIG. 11, a proximal end 1110 includes back fins that are positioned above back seal 1035 and have a larger diameter than back seal 1035. This may enable the back fins of wiper plug 1105 to stabilize wiper plug 1105 while wiper plug 1105 is being inserted into landing collar 110.

Figure 12:
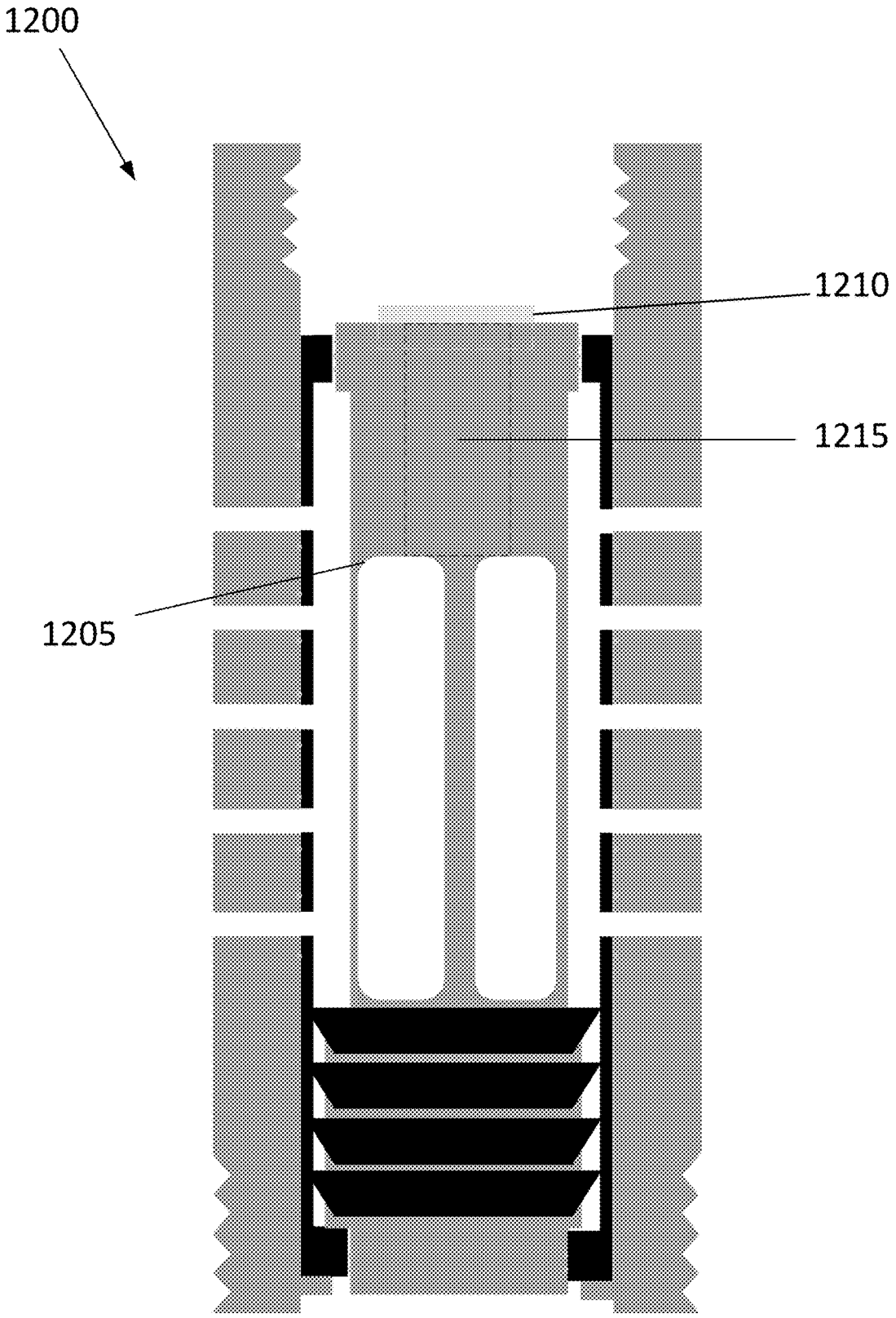
FIG. 12 depicts a landing collar with an internal sleeve that is activated via a wiper plug, according to an embodiment.

FIG. 12 depicts a wiper plug system 1200, according to an embodiment. Elements described in FIG. 12 may be described above, and for the sake of brevity a further description of these elements may be omitted.

As depicted in FIG. 12, a dissolvable cartridge 1210 may be configured to be positioned within or on a seat on a proximal most end of a wiper plug 1205. Dissolvable cartridge 1210 may be configured to block a conduit 1215 while dissolvable cartridge 1210 remains intact. By positioning the seat on the proximal most end of wiper plug 1205, dissolvable cartridge 1210 may be quickly and efficiently changed to have different characteristics, such as different predetermined amount of time before dissolvable cartridge is removed.

Figure 13:
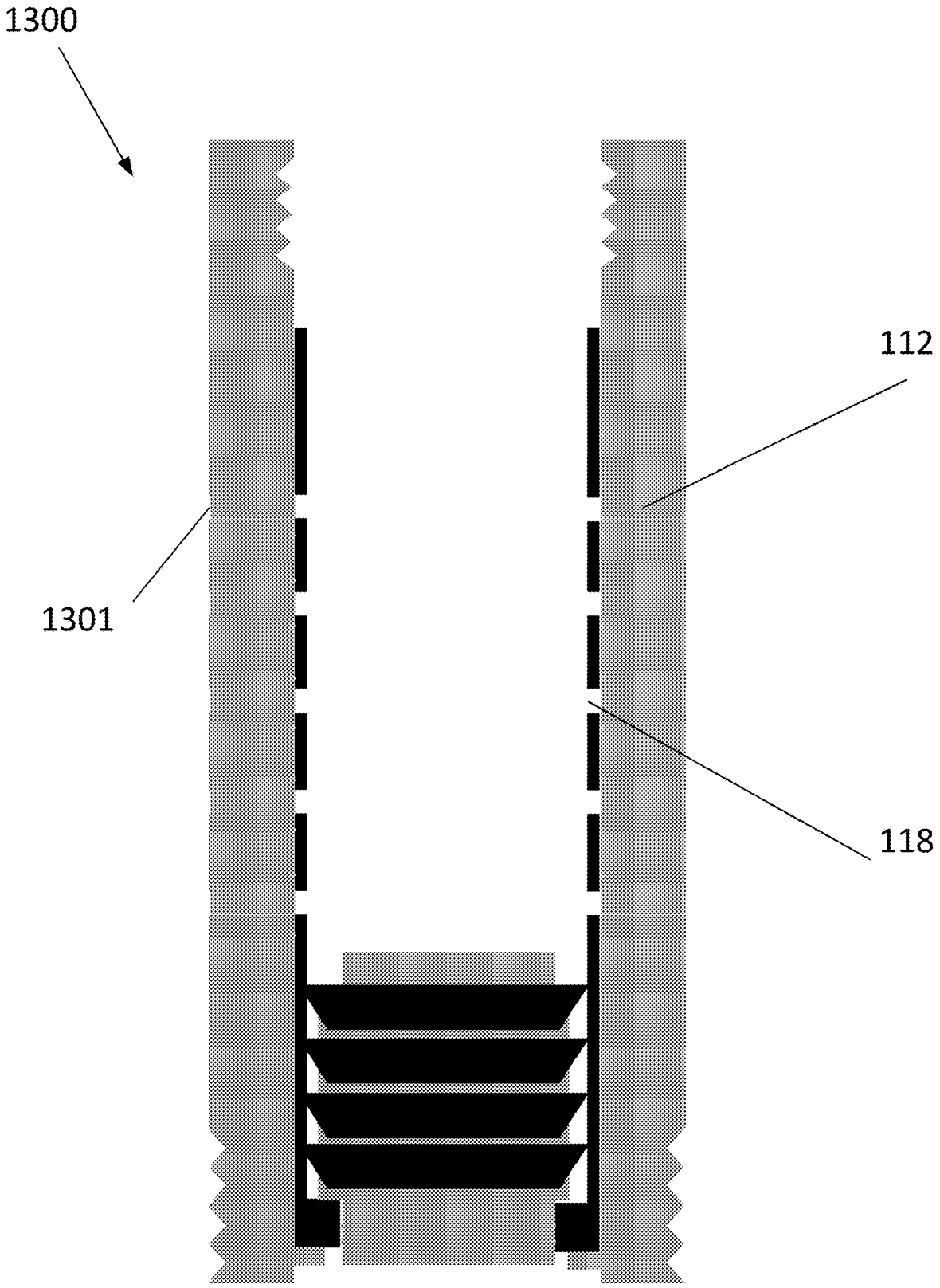
FIG. 13 depicts a landing collar with an internal sleeve that is activated via a wiper plug, according to an embodiment.

As depicted in FIG. 13, a dissolvable cartridge or rupture disc 1301 may be configured to be positioned within landing collar ports 112. Cartridge 1301 may initially prevent flow between inside and outside of the landing collar after first ports 112 and second ports 122 have aligned. However, cartridge 1301 may dissolves after a predetermined amount of time or a certain pressure threshold across cartridge 1301 has been reached. This dissolving of cartridge 1301 may allow communication through first ports 112 and second ports 122.

In other embodiments, cartridge 1301 may be positioned within second ports 122.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A sleeve system, comprising:

a housing with first ports, the first ports extending from an inner diameter of the housing to an outer diameter of the housing;

an internal sleeve with second ports positioned within the housing, the second ports extending from an inner diameter of the internal sleeve to an outer diameter of the internal sleeve; and a wiper plug with fins being configured to be pumped behind cement, the wiper plug being configured to move the internal sleeve from a first position where the first ports are misaligned with the second ports to a second position where the first ports are aligned with the second ports, wherein the wiper plug moves the internal sleeve based on hydraulic pressure applied to the wiper plug, the fins being configured to wipe the cement from an inner diameter of casing as the wiper plug is being pumped downhole.

2. The sleeve system of claim 1, wherein the housing is a cementable landing collar, and the fins extend across an inner diameter of casing to wipe cement from the inner diameter of the casing.

3. The sleeve system of claim 1, further comprising:

a shoulder positioned on the inner diameter of the housing;

a projection positioned on the inner diameter of the internal sleeve, wherein in the first position the shoulder is offset from the projection and in the second position the projection is positioned on the shoulder.

4. The sleeve system of claim 3, wherein the wiper plug is configured to land on the projection.

5. The sleeve system of claim 3, further comprising:

a first seal positioned between the projection and a nose of the wiper plug.

6. The sleeve system of claim 1, further comprising:

a conduit extending from a proximal end of the wiper plug body to windows positioned within the wiper plug;

an object positioned along the conduit, wherein the object is configured to temporarily block the conduit.

7. The sleeve system of claim 6, wherein the object is a dissolvable object.

8. The sleeve system of claim 7, wherein the object is placed above the conduit.

9. The sleeve system of claim 8, wherein the internal sleeve is configured to be run in hole with the housing in the first position and stays in the first position while cement is pumped downhole.

10. The sleeve system of claim 9, wherein the conduit and windows are configured to allow a fracture procedure thought the conduit and the windows when the internal sleeve is in the second position.

11. The sleeve system of claim 1, further comprising:

dissolvable material or a rupture disc configured to be positioned within the first ports.

12. The sleeve system of claim 1, wherein the wiper plug is made out dissolvable material.

13. A method associated with an internal sleeve, comprising:

positioning an internal sleeve with second ports within a housing with first ports, the first ports extending from an inner diameter of the housing to an outer diameter of the housing, the second ports extending from an inner diameter of the internal sleeve to an outer diameter of the internal sleeve;

pumping cement downhole;

pumping a wiper plug with fins downhole behind the cement;

wiping the cement via the fins of the wiper plug from an inner diameter of casing as the wiper plug is being pumped downhole' moving, via hydraulic forces applied to the wiper plug, the internal sleeve from a first position where the first ports are misaligned with the second ports to a second position where the first ports are aligned with the second ports.

14. The method of claim 13, further comprising:

cementing the housing before pumping the wiper plug downhole;

wherein the cement finishes moving around the housing when the wiper plug lands and is seated on the internal sleeve.

15. The method of claim 13, further comprising:

positioning a projection on the inner diameter of the internal sleeve away from a shoulder on the inner diameter of the housing;

moving the projection to be positioned adjacent to the shoulder when moving the internal sleeve from the first position to the second position.

16. The method of claim 15, further comprising:

landing the wiper plug on the projection;

applying pressure to the projection via the wiper plug;

sliding the internal sleeve from the first position to the second position based on the applied pressure to the projection.

17. The method of claim 15, further comprising:

forming a first seal between the projection and a nose of the wiper plug.

18. The method of claim 13, further comprising:

dissolving dissolvable material or a rupture disc within the first ports.

19. The method of claim 13, wherein the wiper plug is made out dissolvable material.

20. A method associated with a downhole tool, comprising:

positioning an internal sleeve with second ports within a housing with first ports, the first ports extending from an inner diameter of the housing to an outer diameter of the housing, the second ports extending from an inner diameter of the internal sleeve to an outer diameter of the internal sleeve;

moving, via hydraulic forces applied to a wiper plug, the internal sleeve from a first position where the first ports are misaligned with the second ports to a second position where the first ports are aligned with the second ports;

temporarily blocking communication through a conduit via an object, the conduit extending from a proximal end of the wiper plug body to windows positioned within the wiper plug; wherein the object is a dissolvable object, wherein the object is placed above the conduit, wherein the internal sleeve is run in hole with the housing in the first position and stays in the first position while cement is pumped downhole;

performing a fracturing procedure through the conduit and windows when the internal sleeve is in the second position.

* * * * *